US011510469B2

(12) United States Patent
Tan

(10) Patent No.: US 11,510,469 B2
(45) Date of Patent: Nov. 29, 2022

(54) STORAGE BAG WITH LIGHTING FUNCTION

(71) Applicant: Hangzhou Tan, Meizhou (CN)

(72) Inventor: Hangzhou Tan, Meizhou (CN)

( * ) Notice: Subject to any disclaimer, the term of this patent is extended or adjusted under 35 U.S.C. 154(b) by 273 days.

(21) Appl. No.: 17/105,523

(22) Filed: Nov. 26, 2020

(65) Prior Publication Data

US 2022/0142322 A1 May 12, 2022

(30) Foreign Application Priority Data

Nov. 11, 2020 (CN) ..... 202022603909.X

(51) Int. Cl.
*A45C 15/06* (2006.01)
*A45C 3/00* (2006.01)

(52) U.S. Cl.
CPC ..... *A45C 15/06* (2013.01); *A45C 3/00* (2013.01); *A45C 2200/10* (2013.01)

(58) Field of Classification Search
CPC ..... A45C 15/06; A45C 3/00
See application file for complete search history.

(56) References Cited

U.S. PATENT DOCUMENTS 6,431,724 B1 * 8/2002 Tedham ..... A45C 15/06 362/570
6,637,485 B1 * 10/2003 Sartena ..... A45C 3/06 383/106

* cited by examiner

*Primary Examiner* — Thomas M Sember

(57) ABSTRACT

The present disclosure provides a storage a with lighting function, including an upper cover, a lamp panel, and a see-through bag body. A battery is movably disposed inside the upper cover, a rope is disposed on both sides of the upper cover, a first middle cover and a second middle cover are movably disposed on an outer side of the upper cover, a lower cover is fixedly disposed on a bottom of the upper cover, the lamp panel is fixedly disposed between the lower cover and the upper cover, the see-through bag body is disposed on a lower side of the lamp panel, one end of the see-through bag body is disposed in the first middle cove and the second middle cover, a see-through bag bottom is fixedly disposed on a bottom the see-through bag body, and a base is fixedly disposed on a bottom of the see-through bag bottom.

6 Claims, 1 Drawing Sheet

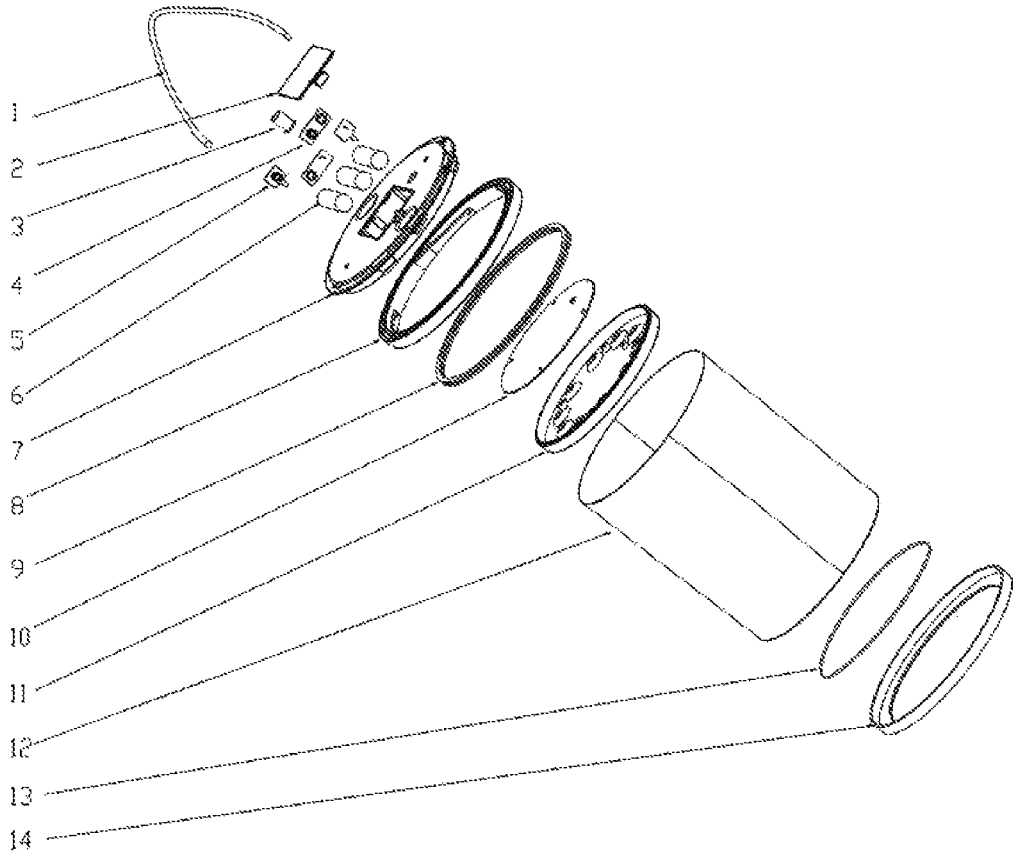
1
2
3
4
5
6
7
8
9
10
11
12
13
14

STORAGE BAG WITH LIGHTING FUNCTION

TECHNICAL FIELD

The present disclosure relates to a technical field of storage bags, in particular to a storage bag with lighting function.

BACKGROUND

In life, there are always articles, such as toys, clothes, bags and the like that are placed at will, so that space is occupied and disordered, which brings a lot of inconvenience to life. Storage bags are a practical tool that can effectively and reasonably store all kinds of the toys, the clothes, the bags and the like, thus reducing the occupied space and making the space orderly.

Traditional storage bags only provide a function of storing the articles, the function is single, especially in outdoor camping, where the storage bags have a good storage effect on arrangement of various clamping articles, but the simple storage function cannot meet multifunctional requirements of present storage bags.

SUMMARY

The present disclosure provides a storage bag with lighting function, aiming at solving above technical problem.

In order to achieve above abject, the present disclosure provides following technical solutions.

The present disclosure provides a storage bag with lighting function, including an upper cover, a lamp panel, and a see-through bag body. A battery is movably disposed inside the upper cover, a rope is disposed on both sides of the upper cover, a first middle cover and a second middle cover are movably disposed on an outer side of the upper cover, a lower cover is fixedly disposed on a bottom of the upper cover, the lamp panel is fixedly disposed between the lower cover and the upper cover, the see-through bag body is disposed on a lower side of the lamp panel, one end of the see-through bag body is fixedly disposed in the first middle cover and the second middle cover, a see-through bag bottom is fixedly disposed on a bottom of the see-through bag body, and a base is fixedly disposed on a bottom of the see-through bag bottom.

Furthermore, a pair of circular holes is symmetrically disposed on both sides of the upper cover, two ends of the rope are respectively connected in the pair of the circular holes.

Furthermore, a battery groove is disposed inside the upper cover, a positive contact point and a negative contact point are respectively disposed on two ends of the battery groove. The battery is disposed inside the battery groove, a battery cover is disposed on an outer side of the battery groove, a key is disposed on one side of an upper end surface of the upper cover.

Furthermore, a pair of finger holes is symmetrically disposed on two sides of the upper end surface of the upper cover, and a periphery of a lower side of the upper cover is clamped with the first middle cover.

Furthermore, a plurality of lamp beads are disposed inside the lamp panel, a plurality of lamp bead expansion slots are disposed inside the lower cover, and the plurality of the lamp beads are respectively disposed inside the plurality of the lamp bead expansion slots.

Furthermore, an upper end of the see-through bag body is in voltage bonding connection with the first middle cover and the second middle cover.

Compared with the prior art, the present disclosure provides the storage bag with lighting function to realize two functions of storing and lighting at the same time, the storage bag achieves the lighting function when there is a power outage at home, can be placed in a car for storage, can light itself when a fault occurs in a night road, and can further realize the two functions of storing and lighting at the same time in outdoor camping, which provides great convenience for camping enthusiasts.

BRIEF DESCRIPTION OF DRAWINGS

FIG. 1 is an exploded structural schematic diagram of a storage bag with lighting function of the present disclosure.

In the drawings: 1. rope; 2. battery cover; 3. key; 4. positive contact point; 5. negative contact point; 6. battery; 7, upper cover; 8. first middle cover; 9, second middle cover; 10. lamp panel; 11. lower cover; 12. see-through bag body; 13—see-through bag bottom; 14. base.

DETAILED DESCRIPTION

In the description of the present disclosure, it should be understood that a. orientation or positional relationship indicated by the terms "upper", "lower", "top", "bottom", "inner", "outer" etc., is based on the orientation or positional relationship shown in the FIGURES, but is merely for ease of description of the present disclosure and simplification description, rather than to indicate or imply that the indicated device or element must have a particular orientation, constructed and operated in a particular orientation, and therefore not to be construed as limiting the present disclosure.

In addition, the terms "first" and "second" are used for descriptive purposes only and are not to be construed as indicating or implying relative importance or implicitly indicating a number of technical features indicated. Thus, a feature defining "first" and "second" may explicitly or implicitly include one or more of the features. In the description of the present disclosure; a meaning of "a plurality of" is two or more unless specifically defined otherwise.

In the present disclosure, unless expressly specified and defined otherwise, the terms "dispose", "connect to", "connect with", "fix" and the like are to be construed broadly, for example, may be fixedly connected, may be detachably connected, or integral; may be mechanically connected or electrically connected; may be directly connected, may also be indirectly connected by an intermediate medium, or may be an interaction relationship between two elements, The specific meanings of the above-described terms in the present disclosure may be understood by those skilled in the art based on specific circumstances.

Technical solutions of the present disclosure are described in details below in conjunction with detailed embodiments.

Embodiment 1

As shown in FIG. 1, the present disclosure provides a storage bag with lighting function, including an upper cover 7, a lamp panel 10, and a see-through bag body 12. A battery 6 is movably disposed inside the upper cover 7, a rope 1 is disposed on both sides of the upper cover 7, a first middle cover 8 and a second middle cover 9 are movably disposed on an outer side of the upper cover 7, a lower cover 11 is fixedly disposed on a bottom of the upper cover 7, the lamp panel 10 is fixedly disposed between the lower cover 11 and the upper cover 7, the see-through bag body 12 is disposed on a lower side of the lamp panel 10, one end of the see-through bag body 12 is fixedly disposed in the first middle cover 8 and the second middle cover 9, a see-through bag bottom 13 is fixedly disposed on a bottom of the see-through bag body 12, and a base 14 is fixedly disposed on a bottom of the see-through bag bottom 13.

Ten lamp beads are disposed inside the lamp panel 10, ten lamp bead expansion slots are disposed inside the lower cover 11, and the ten lamp beads are respectively disposed inside the ten lamp bead expansion slots.

A working principle of embodiment 1 is as following.

In normal use, the see-through bag body 12 is detached and installed through the first middle cover 8 and the second middle cover 9, so that articles can be stored in the see-through bag body 12 and a storing function of the storage bag is achieved. When there is a power outage or there is outdoor camping, the storage bag is suspended through the rope 1, the lamp beads in the lamp panel 10 emit light, the light is diffused into the see-through bag body 12 through the lamp bead expansion slots, and the light is further diffused out through the see-through bag body 12 and the see-through bag bottom 13 for illumination.

Embodiment 2

As shown in FIG. 1, the present disclosure provides the storage bag with lighting function, based on the embodiment 1, a pair of circular holes is symmetrically, disposed on both sides of the upper cover 7, two ends of the rope 1 are respectively connected in the pair of the circular holes, The rope 1 is convenient for suspension of the storage bag and hand-held use, A battery groove is disposed inside the upper cover 7, a positive contact point 4 and a negative contact point 5 are respectively disposed on two ends of the battery groove. The battery 6 is disposed inside the battery groove, a battery cover 2 is disposed on an outer side of the battery groove, and electric energy is provided in the battery groove by using AA batteries, which cost is low. A key 3 is disposed on one side of an upper end surface of the upper cover 7, and the key 3 is configure to switch the light on and off. A pair of finger holes is symmetrically disposed on two sides of the upper end surface of the upper cover 7, which is convenient for users to insert fingers into the pair of the finger holes and twist the upper cover 7, and a periphery of a lower side of the upper cover 7 is clamped with the first middle cover 8. An upper end of the see-through bag body 12 is in voltage bonding connection with the first middle cover 8 and the second middle cover 9.

The above-disclosed are only preferred embodiments of the present disclosure, which certainly cannot be used to limit the scopes of the present disclosure. Therefore, equivalent changes made according to the claims of the present disclosure still fall within the scopes of the present disclosure. Any drawing marks in claims should not be regarded as limiting the claims involved.

In addition, it should be understood that although this specification is described in accordance with implementation manners, not each implementation manner only includes an independent technical solution. This narration in the specification is only for clarity, and those skilled in the art should consider the specification as a whole. The technical solutions in each embodiment can also be appropriately combined to form other implementations that can be understood by those skilled in the art.

What is claimed is:

1. A storage bag with lighting function, comprising;
an upper cover (7);
a lamp panel (10); and
a see-through bag body (12);
wherein a battery (6) is movably disposed inside the upper cover (7), a rope (1) is disposed on both sides of the upper cover (7), a first middle cover (8) and a second middle cover (9) are movably disposed on an outer side of the upper cover (7), a lower cover (11) is fixedly disposed on a bottom of the upper cover (7), the lamp panel (10) is fixedly disposed between the lower cover (11) and the upper cover (7), the see-through bag body (12) is disposed on a lower side of the lamp panel (10), one end of the see-through bag body (12) is fixedly disposed in the first middle cover (8) and the second middle cover (9), a see-through bag bottom (13) is fixedly disposed on a bottom of the see-through bag body (12), and a base (14) is fixedly disposed on a bottom of the see-through bag bottom (13).

2. The storage bag with lighting function according to claim 1, wherein a pair of circular holes is symmetrically disposed on both sides of the upper cover (7), two ends of the rope (1) are respectively connected in the pair of the circular holes.

3. The storage bag with lighting function according to claim 2, wherein a battery groove is disposed inside the upper cover (7), a positive contact point (4) and a negative contact point (5) are respectively disposed on two ends of the battery groove; the battery (6) is disposed inside the battery groove, a battery cover (2) is disposed on an outer side of the battery groove, a key (3) is disposed on one side of an upper end surface of the upper cover (7).

4. The storage bag with lighting function according to claim 3, wherein a pair of finger holes is symmetrically disposed on two sides of the upper end surface of the upper cover (7), and a periphery of a lower side of the upper cover (7) is clamped with the first middle cover (8).

5. The storage hag with lighting function according to claim 1, wherein a plurality of lamp beads are disposed inside the lamp panel (10), a plurality of lamp bead expansion slots are disposed inside the lower cover (11), and the plurality of the lamp beads are respectively disposed inside the plurality of the lamp bead expansion slots.

6. The storage bag with lighting function according to claim 1, wherein an upper end of the see-through bag body (12) is in voltage bonding connection with the first middle cover (8) and the second middle cover (9).

* * * * *